US008371480B2

(12) United States Patent
Wang

(10) Patent No.: US 8,371,480 B2
(45) Date of Patent: Feb. 12, 2013

(54) CONTAINER HAVING A COMPRESSIBLE FUNCTION

(75) Inventor: Ching-Te Wang, Nansi Township, Tainan County (TW)

(73) Assignees: Lian Sheng Co., Ltd., Taiping (TW); Ching-Te Wang, Wanciou Village (TW)

( * ) Notice: Subject to any disclaimer, the term of this patent is extended or adjusted under 35 U.S.C. 154(b) by 537 days.

(21) Appl. No.: 12/652,270

(22) Filed: Jan. 5, 2010

(65) Prior Publication Data

US 2011/0163129 A1 Jul. 7, 2011

(51) Int. Cl.
*B65D 88/54* (2006.01)

(52) U.S. Cl. ..... 222/320; 222/319; 222/386; 222/405; 401/82; 401/178

(58) Field of Classification Search ..... 222/319, 222/320, 386, 387, 405, 131, 183, 390, 391; 401/82, 176, 178
See application file for complete search history.

(56) References Cited

U.S. PATENT DOCUMENTS

| | | | | |
|---|---|---|---|---|
| 1,603,013 | A * | 10/1926 | Bagley | 222/320 |
| 2,461,211 | A * | 2/1949 | Guthrie | 222/326 |
| 2,763,405 | A * | 9/1956 | Shvetz | 222/320 |
| 3,249,265 | A * | 5/1966 | Wershaw et al. | 222/320 |
| 5,513,778 | A * | 5/1996 | Cardia et al. | 222/327 |
| 6,655,557 | B2 * | 12/2003 | Rousselet et al. | 222/391 |

* cited by examiner

*Primary Examiner* — J. Casimer Jacyna
(74) *Attorney, Agent, or Firm* — Alan Kamrath; Kamrath IP Lawfirm, P.A.

(57) ABSTRACT

A container includes a housing, a container body mounted in the housing and having an inner portion provided with a receiving chamber and a pusher movably mounted in the receiving chamber and having a surface provided with an outlet hole connected to the receiving chamber. The receiving chamber has a bottom wall provided with a stop portion. The pusher has a bottom wall provided with a pressing portion that is movable to closely abut the stop portion. Thus, the pressing portion can be moved to closely abut the stop portion so as to completely squeeze the cosmetic filling outwardly from the outlet hole and to prevent part of the cosmetic filling from being left in the receiving chamber so that the user can use the cosmetic filling to the maximum extent.

16 Claims, 4 Drawing Sheets

CONTAINER HAVING A COMPRESSIBLE FUNCTION

BACKGROUND OF THE INVENTION

1. Field of the Invention

The present invention relates to a container and, more particularly, to a cosmetic container containing cosmetic products and the like.

2. Description of the Related Art

A conventional cosmetic container comprises a flexible container body having an inner portion provided with a receiving chamber containing a cosmetic filling and having a top provided with a spout connected to the receiving chamber, and a lid removably mounted on the top of the container body to seal the spout of the container body. When in use, the lid is removed from the top of the container body to expose the spout of the container body. Thus, the user can compress the periphery of the container body to squeeze the cosmetic filling in the receiving chamber of the container body so that the cosmetic filling can be squeezed outwardly from the spout of the container body for use with the user. However, when the cosmetic filling is to be used up, the receiving chamber of the container body cannot be squeezed any more so that part of the cosmetic filling is still left in the receiving chamber of the container body and cannot be compressed completely, thereby causing waste of the cosmetic filling.

BRIEF SUMMARY OF THE INVENTION

In accordance with the present invention, there is provided a container, comprising a housing, a container body mounted in the housing and having an inner portion provided with a receiving chamber containing a cosmetic filling and a pusher movably mounted in the receiving chamber of the container body and having a surface provided with an outlet hole connected to the receiving chamber of the container body. The receiving chamber of the container body has a bottom wall provided with a stop portion. The pusher has a bottom wall provided with a pressing portion that is movable to closely abut the stop portion of the container body.

Preferably, the pressing portion of the pusher has a shape and a size matching that of the stop portion of the container body. Preferably, the stop portion of the container body has a substantially convex profile and extends toward the pusher, and the pressing portion of the pusher has a substantially concave profile. Preferably, the pressing portion of the pusher has a top provided with the outlet hole. Preferably, the outlet hole of the pusher is located at a central portion of the pressing portion of the pusher. Preferably, the pusher has a substantially disk-shaped profile, and the receiving chamber of the container body has a circular profile. Preferably, the container further comprises a plug removably mounted in the outlet hole of the pusher to releasably seal the outlet hole of the pusher and to interrupt a connection between the outlet hole of the pusher and the receiving chamber of the container body, and a lid removably mounted on the housing to cover the container body and the pusher. Preferably, the lid abuts the plug to press and retain the plug in the outlet hole of the pusher. Preferably, the stop portion of the container body has a top provided with a protruding insert that is inserted into the outlet hole of the pusher when the pusher is movable to abut the stop portion of the container body. Preferably, the insert of the container body is located at a central portion of the stop portion of the container body. Preferably, the pusher has a peripheral wall provided with a guide portion that is slidable in the receiving chamber of the container body to guide movement of the pusher in the receiving chamber of the container body. Preferably, the guide portion of the pusher has a size flush with that of the receiving chamber of the container body to seal the receiving chamber of the container body. Preferably, the receiving chamber of the container body has a circular profile, and the guide portion of the pusher has a substantially cylindrical profile.

The primary objective of the present invention is to provide a container having a compressible function.

According to the primary objective of the present invention, the cosmetic filling in the receiving chamber of the container body is pressed outwardly from the outlet hole of the pusher by pressing the pusher downward so as to facilitate the user using the cosmetic filling in the receiving chamber of the container body.

According to another objective of the present invention, the pressing portion of the pusher can be moved to closely abut the stop portion of the container body so as to completely squeeze the cosmetic filling outwardly from the outlet hole of the pusher and to prevent part of the cosmetic filling from being left in the receiving chamber of the container body so that the user can use the cosmetic filling to the maximum extent.

According to a further objective of the present invention, the container has a simplified construction, thereby decreasing the costs of fabrication.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
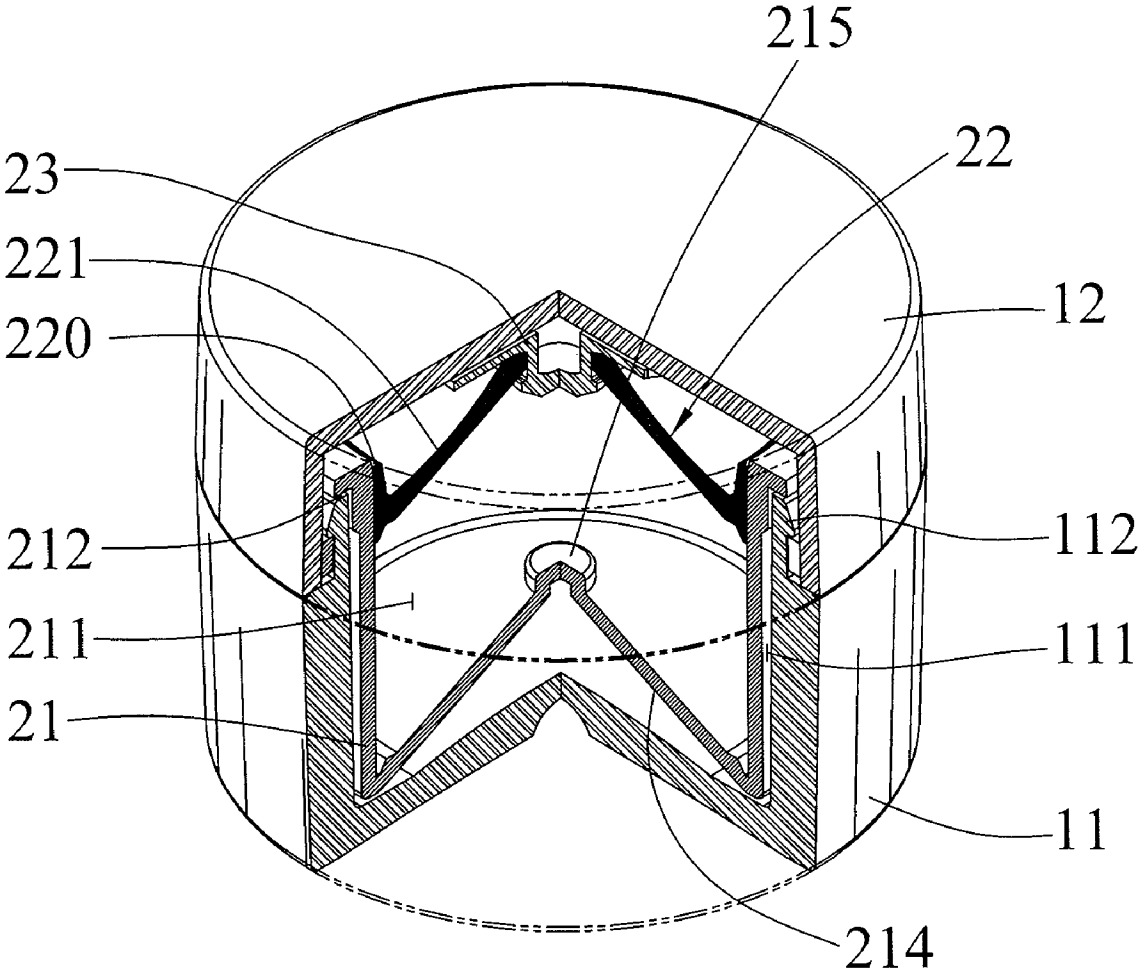
FIG. 1 is a partially broken perspective cross-sectional view of a container in accordance with the preferred embodiment of the present invention.
Figure 2:
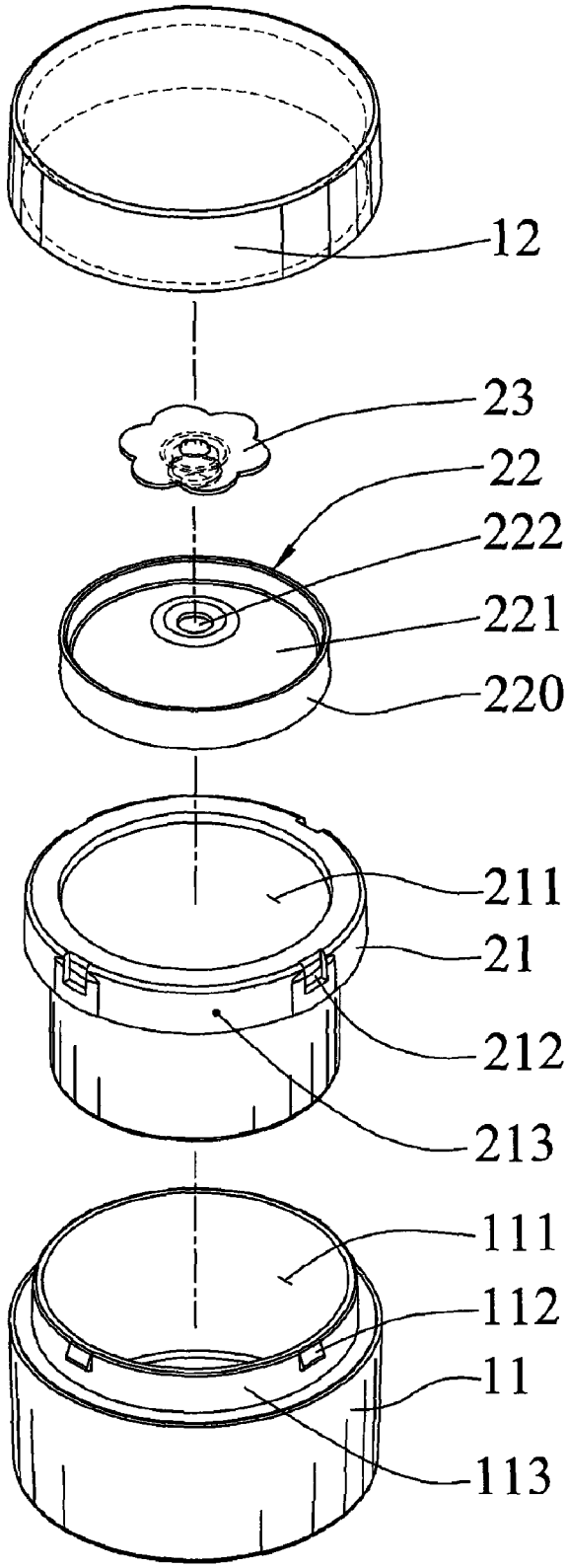
FIG. 2 is an exploded perspective view of the container as shown in FIG. 1.
Figure 3:
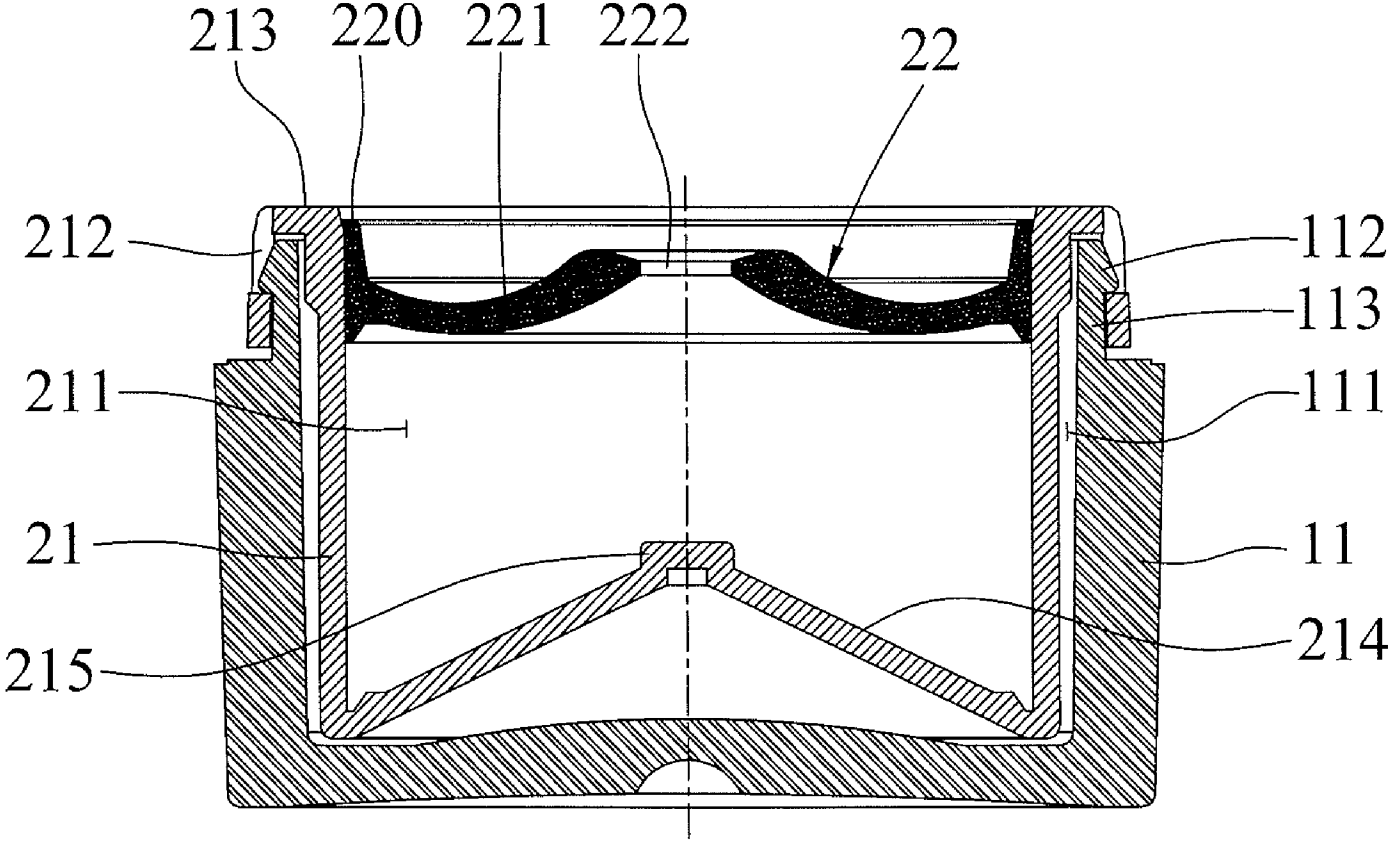
FIG. 3 is a front cross-sectional view of the container as shown in FIG. 1.

Referring to the drawings and initially to FIGS. 1-3, a container in accordance with the preferred embodiment of the present invention comprises a housing 11, a container body 21 mounted in the housing 11 and having an inner portion provided with a receiving chamber 211 containing a cosmetic filling, a pusher 22 movably mounted in the receiving chamber 211 of the container body 21 and having a surface provided with an outlet hole 222 connected to the receiving chamber 211 of the container body 21, a plug 23 removably mounted in the outlet hole 222 of the pusher 22 to releasably seal the outlet hole 222 of the pusher 22 and to interrupt a connection between the outlet hole 222 of the pusher 22 and the receiving chamber 211 of the container body 21, and a lid 12 removably mounted on the housing 11 to cover the container body 21 and the pusher 22.

The housing 11 has an inner portion provided with a receiving space 111 to receive the container body 21. The housing 11 has a reduced upper portion 113 provided with a plurality of locking blocks 112.

The container body 21 has an enlarged upper portion 213 provided with a plurality of locking grooves 212 locked onto the locking blocks 112 of the housing 11 to lock the container body 21 onto the housing 11. The enlarged upper portion 213 of the container body 21 protrudes outwardly from the receiving space 111 of the housing 11 and abuts the reduced upper portion 113 of the housing 11. The receiving chamber 211 of the container body 21 has a circular profile. The receiving chamber 211 of the container body 21 has a bottom wall provided with a stop portion 214. Preferably, the stop portion 214 of the container body 21 has a substantially convex profile and extends toward the pusher 22. The stop portion 214 of the container body 21 has a top provided with a protruding insert 215 that is inserted into the outlet hole 222 of the pusher 22 when the pusher 22 is movable to abut the stop portion 214 of the container body 21. Preferably, the insert 215 of the container body 21 is located at a central portion of the stop portion 214 of the container body 21.

The pusher 22 has a substantially disk-shaped profile and has a bottom wall provided with a pressing portion 221 that is movable to closely abut the stop portion 214 of the container body 21. The pressing portion 221 of the pusher 22 has a shape and a size matching that of the stop portion 214 of the container body 21. Preferably, the pressing portion 221 of the pusher 22 has a substantially concave profile. The pressing portion 221 of the pusher 22 has a top provided with the outlet hole 222. Preferably, the outlet hole 222 of the pusher 22 is located at a central portion of the pressing portion 221 of the pusher 22. The pusher 22 has a peripheral wall provided with a guide portion 220 that is slidable in the receiving chamber 211 of the container body 21 to guide movement of the pusher 22 in the receiving chamber 211 of the container body 21. The guide portion 220 of the pusher 22 has a substantially cylindrical profile and has a size flush with that of the receiving chamber 211 of the container body 21 to seal the receiving chamber 211 of the container body 21.

The lid 12 is removably mounted on the reduced upper portion 113 of the housing 11 and abuts the plug 23 to press and retain the plug 23 in the outlet hole 222 of the pusher 22 when not in use.

Figure 4:
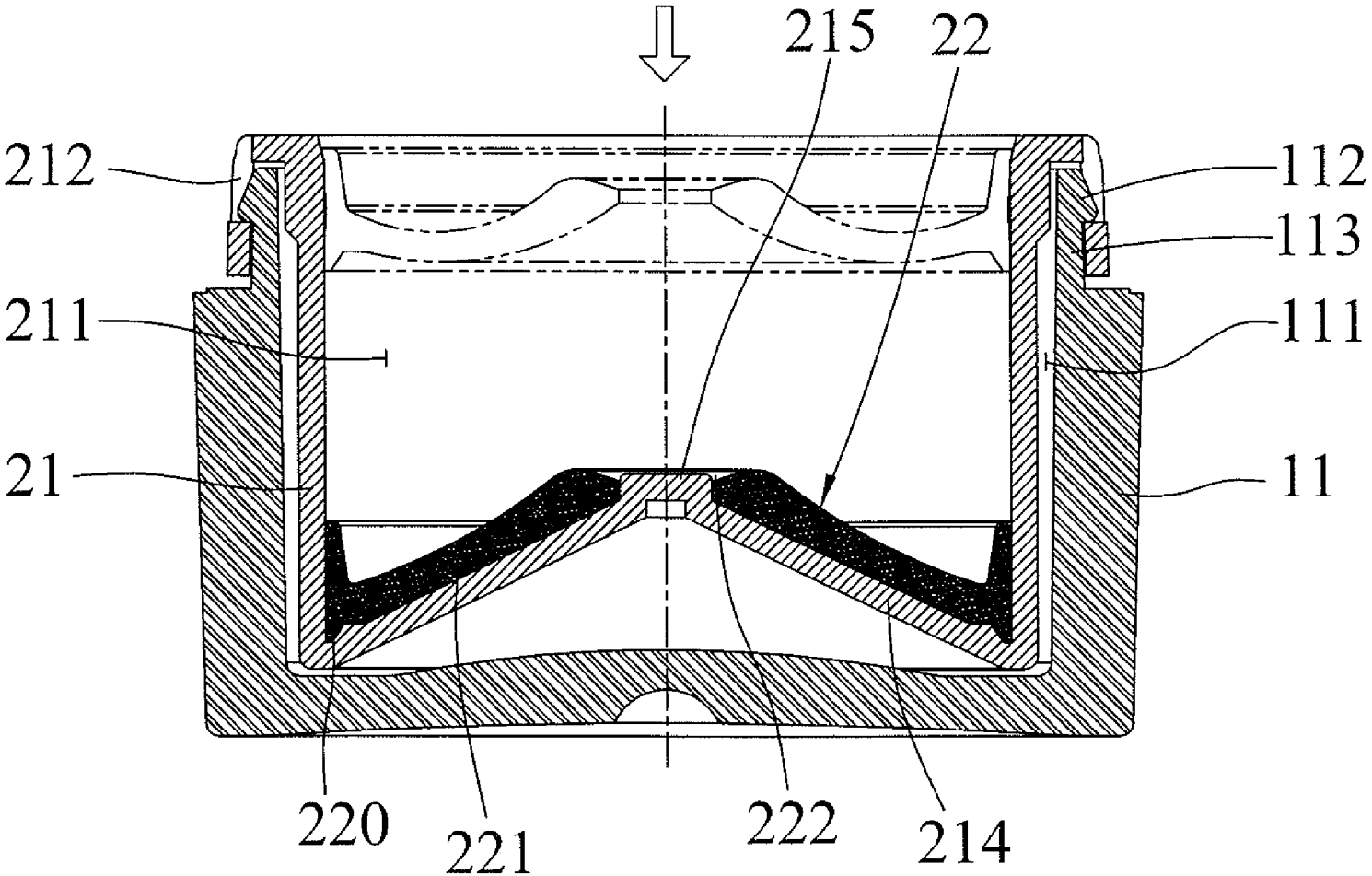
FIG. 4 is a schematic operational view of the container as shown in FIG. 3 in use.

In operation, referring to FIGS. 3 and 4 with reference to FIGS. 1 and 2, after the lid 12 is removed from the housing 11, the plug 23 can be removed from the outlet hole 222 of the pusher 22 to expose the outlet hole 222 of the pusher 22 to the ambient environment as shown in FIG. 3. In such a manner, when the pusher 22 is pressed downward by a user, the pressing portion 221 of the pusher 22 is moved toward the stop portion 214 of the container body 21 to compress and squeeze the cosmetic filling contained in the receiving chamber 211 of the container body 21 so that the cosmetic filling in the receiving chamber 211 of the container body 21 is pressed outwardly from the outlet hole 222 of the pusher 22 for use with the user. It is appreciated that, the pressing portion 221 of the pusher 22 can be moved to closely abut the stop portion 214 of the container body 21 as shown in FIG. 4 so as to completely squeeze the cosmetic filling outwardly from the outlet hole 222 of the pusher 22 so that the user can use the cosmetic filling to the maximum extent.

Accordingly, the cosmetic filling in the receiving chamber 211 of the container body 21 is pressed outwardly from the outlet hole 222 of the pusher 22 by pressing the pusher 22 downward so as to facilitate the user using the cosmetic filling in the receiving chamber 211 of the container body 21. In addition, the pressing portion 221 of the pusher 22 can be moved to closely abut the stop portion 214 of the container body 21 so as to completely squeeze the cosmetic filling outwardly from the outlet hole 222 of the pusher 22 and to prevent part of the cosmetic filling from being left in the receiving chamber 211 of the container body 21 so that the user can use the cosmetic filling to the maximum extent. Further, the container has a simplified construction, thereby decreasing the costs of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A container comprising:

a housing;

a container body mounted in the housing and having an inner portion provided with a receiving chamber containing a cosmetic filling, wherein the housing has an inner portion provided with a receiving space to receive the container body; and a pusher movably mounted in the receiving chamber of the container body and having a surface provided with an outlet hole connected to the receiving chamber of the container body, wherein the housing has a reduced upper portion provided with a plurality of locking blocks; and the container body has an enlarged upper portion provided with a plurality of locking grooves locked onto the plurality of locking blocks of the housing to lock the container body onto the housing.

2. The container of claim 1, wherein the receiving chamber of the container body has a bottom wall provided with a stop portion; and the pusher has a bottom wall provided with a pressing portion movable to closely abut the stop portion of the container body.

3. The container of claim 2, wherein the pressing portion of the pusher has a shape and a size matching the stop portion of the container body.

4. The container of claim 3, wherein the stop portion of the container body has a substantially convex profile and extends toward the pusher; and the pressing portion of the pusher has a substantially concave profile.

5. The container of claim 2, wherein the pressing portion of the pusher has a top provided with the outlet hole.

6. The container of claim 5, wherein the outlet hole of the pusher is located at a central portion of the pressing portion of the pusher.

7. The container of claim 1, wherein the pusher has a substantially disk-shaped profile; and the receiving chamber of the container body has a circular profile.

8. The container of claim 1, further comprising:

a plug removably mounted in the outlet hole of the pusher to releasably seal the outlet hole of the pusher and to interrupt a connection between the outlet hole of the pusher and the receiving chamber of the container body.

9. The container of claim 8, further comprising:

a lid removably mounted on the housing to cover the container body and the pusher.

10. The container of claim 9, wherein the lid abuts the plug to press and retain the plug in the outlet hole of the pusher.

11. The container of claim 2, wherein the stop portion of the container body has a top provided with a protruding insert inserted into the outlet hole of the pusher when the pusher is movable to abut the stop portion of the container body.

12. The container of claim 11, wherein the insert of the container body is located at a central portion of the stop portion of the container body.

13. The container of claim 2, wherein the pusher has a peripheral wall provided with a guide portion slidable in the receiving chamber of the container body to guide movement of the pusher in the receiving chamber of the container body.

14. The container of claim 13, wherein the guide portion of the pusher has a size flush with the receiving chamber of the container body to seal the receiving chamber of the container body.

15. The container of claim 14, wherein the receiving chamber of the container body has a circular profile; and the guide portion of the pusher has a substantially cylindrical profile.

16. The container of claim 1, wherein the enlarged upper portion of the container body protrudes outwardly from the receiving space of the housing and abuts the reduced upper portion of the housing.

* * * * *